US008522968B2

(12) United States Patent
Middleman et al.

(10) Patent No.: US 8,522,968 B2
(45) Date of Patent: Sep. 3, 2013

(54) BEVERAGE FLAVORING APPLICATOR

(75) Inventors: Mark L. Middleman, San Antonio, TX (US); James D. Benner, Jr., San Antonio, TX (US); William B. Putty, Helotes, TX (US)

(73) Assignee: Shinie Hinie LLC, San Antonio, TX (US)

( * ) Notice: Subject to any disclaimer, the term of this patent is extended or adjusted under 35 U.S.C. 154(b) by 214 days.

(21) Appl. No.: 13/106,749

(22) Filed: May 12, 2011

(65) Prior Publication Data

US 2011/0278184 A1 Nov. 17, 2011

Related U.S. Application Data

(60) Provisional application No. 61/334,768, filed on May 14, 2010.

(51) Int. Cl.
*B65D 25/08* (2006.01)

(52) U.S. Cl.
USPC ..... 206/222; 206/568; 206/219

(58) Field of Classification Search
USPC ..... 206/222, 219, 568, 217; 215/DIG. 8; 220/521, 254.2, 281
See application file for complete search history.

(56) References Cited

U.S. PATENT DOCUMENTS

| | | | | |
|---|---|---|---|---|
| 2,631,521 | A | 3/1953 | Atkins, Jr. | |
| 3,779,372 | A | 12/1973 | de Lloret | |
| 3,840,136 | A * | 10/1974 | Lanfranconi et al. | 215/6 |
| 4,159,570 | A * | 7/1979 | Baskas et al. | 433/90 |
| 5,071,042 | A * | 12/1991 | Esposito | 222/570 |
| 5,176,278 | A * | 1/1993 | Quarberg | 220/320 |
| 6,098,795 | A | 8/2000 | Mollstam et al. | |
| 6,155,452 | A * | 12/2000 | Laurent | 220/739 |
| 6,372,270 | B1 * | 4/2002 | Denny | 426/77 |
| 6,644,471 | B1 | 11/2003 | Anderson | |
| 7,249,690 | B2 | 7/2007 | Smith et al. | |
| 7,279,187 | B2 | 10/2007 | Daniels et al. | |
| 7,308,915 | B2 | 12/2007 | Johns et al. | |
| 7,328,670 | B2 | 2/2008 | Puentes-Barr | |
| 7,523,823 | B1 | 4/2009 | Bednar | |

(Continued)

FOREIGN PATENT DOCUMENTS

WO WO2010029585 3/2010

OTHER PUBLICATIONS

International Search Report and Written Opinion for co-pending PCT Patent App. No. PCT/US11/36541.

*Primary Examiner* — Steven A. Reynolds
(74) *Attorney, Agent, or Firm* — Cox Smith Matthews Incorporated

(57) ABSTRACT

A beverage flavoring applicator may have a housing having an internal channel, a cup assembly disposed in the internal channel, the cup assembly having a first cup having a first chamber with a first flavoring substance disposed in the first chamber, a second cup having a second chamber with a second flavoring substance disposed in the second chamber, the first and second cups being nested one within the other, and a plunger slidably engaged with the housing, the plunger having a spike configured to rupture the first and second cups upon movement of the plunger from a first position to a second position with respect to the housing, thereby dispensing the first and second flavoring substances from the applicator. The applicator may engage with a beverage container, either with or without an adapter. Some embodiments may have a bottle opener. Methods of making such applicators and adapters are also described.

18 Claims, 13 Drawing Sheets

(56) References Cited

U.S. PATENT DOCUMENTS

| | | | | |
|---|---|---|---|---|
| 7,614,496 | B2 * | 11/2009 | Dvorak et al. | 206/219 |
| 8,356,711 | B2 * | 1/2013 | Canziani Hoffa et al. | 206/222 |
| 2004/0206302 | A1 | 10/2004 | Propp | |
| 2005/0126632 | A1 | 6/2005 | Farrell et al. | |
| 2007/0045134 | A1 * | 3/2007 | Dvorak et al. | 206/222 |
| 2007/0227919 | A1 * | 10/2007 | True | 206/219 |
| 2008/0023349 | A1 * | 1/2008 | Balazik | 206/222 |
| 2008/0202950 | A1 * | 8/2008 | Anderson | 206/219 |
| 2008/0223740 | A1 * | 9/2008 | Ramsey et al. | 206/222 |
| 2008/0245293 | A1 | 10/2008 | Fosmire et al. | |
| 2009/0004343 | A1 | 1/2009 | Xiong et al. | |
| 2010/0116699 | A1 * | 5/2010 | Sorenson | 206/219 |
| 2010/0200437 | A1 * | 8/2010 | Coon | 206/222 |

* cited by examiner

BEVERAGE FLAVORING APPLICATOR

CROSS REFERENCE TO RELATED APPLICATIONS

This application claims the benefit of U.S. Provisional Patent Application No. 61/334,768 filed May 14, 2010, the disclosure of which is incorporated herein by reference.

FIELD

This application relates generally to the field of beverage flavoring devices and methods.

BACKGROUND

It is often considered desirable to add small amounts of flavoring substances to beverage containers. For example, some beer consumers prefer to add lime juice and salt to certain types of beer. Normally, the addition of such flavoring substances involves a messy, unsanitary, and imprecise process, wherein slices of lime are squeezed and inserted directly into a bottle using one's fingers, and salt is poured from a salt shaker directly into a beverage bottle. This process allows the introduction of unsanitary materials and apparatuses into a beverage, waste of flavoring substances, and creates difficulty in controlling the portions of flavoring substances added to each beverage. Accordingly, there is a need for a device and method for the clean, sanitary, and consistent distribution of various flavoring substances into a beverage container.

SUMMARY

In some embodiments, a beverage flavoring applicator may have a housing having an internal channel, a cup assembly disposed in the internal channel, the cup assembly having a first cup having a first chamber with a first flavoring substance disposed in the first chamber, a second cup having a second chamber with a second flavoring substance disposed in the second chamber, the first and second cups being nested one within the other, and a plunger slidably engaged with the housing. The plunger may have a spike configured to rupture the first and second cups upon movement of the plunger from a first position to a second position with respect to the housing, thereby dispensing the first and second flavoring substances from the applicator. The applicator may engage with a bottle, can, or other container, either with or without an adapter. Some embodiments may have a bottle opener.

In some embodiments, a beverage flavoring applicator may have a housing, wherein the housing includes an internal channel extending from a top edge of the housing to a base of the housing, wherein the internal channel is open at the top edge and at the base, wherein the internal channel includes an upper portion having a frustoconical shape, wherein the internal channel further includes first, second and third annular ledges on an upper portion of the frustoconical shape and internal protrusions on a lower portion of the frustoconical shape; a cup assembly disposed within the upper portion of the internal channel, wherein the cup assembly includes: a first cup having a first annular flange and a first chamber, wherein the first flange extends from an upper edge of the first cup and wherein the first chamber includes a first flavoring substance; a second cup having a second annular flange, a recess, and a second chamber, wherein the second flange extends from an upper edge of the second cup and wherein the second chamber includes a second flavoring substance; the first cup being nested within the second cup such that the first flange of the first cup is disposed within the recess of the second cup, wherein a first upper surface of the first flange is substantially coplanar with a second upper surface of the second flange; a seal disposed on the first upper surface and the second upper surface, whereby the first flavoring substance is sealed within the first chamber and the second flavoring substance is sealed within the second chamber; a first shoulder and a second shoulder, wherein the first shoulder is disposed in the first annular ledge, the second shoulder is disposed in the second annular ledge, and the second flange is disposed in the third annular ledge; a base configured to rest on the internal protrusions; and a plunger configured to fit over and slidably engage the housing, the plunger including a spike configured to puncture the first and second cups upon movement of the plunger from a first position to a second position with respect to the housing, the plunger further including internal threads which mate with protrusions disposed on flexible tabs of the housing, wherein the protrusions and the internal threads are configured for twisting initial engagement of the plunger with the housing.

In some embodiments, a cup assembly for a beverage flavoring applicator may have a first cup having a first chamber, wherein the first chamber includes a first flavoring substance; and a second cup having a second chamber, wherein the second chamber includes a second flavoring substance; wherein the first and second cups are nested one within the other.

In some embodiments, a cup assembly for a beverage flavoring applicator may have a first cup having a first chamber and a first annular flange, wherein the first chamber comprises a first flavoring substance; a second cup having a second chamber and a second annular flange, wherein the second chamber includes a second flavoring substance and the second flange includes an annular recess; the first and second cups being nested one within the other such that the first flange is disposed within the recess, wherein a first upper surface of the first flange is substantially flush with a second upper surface of the second flange; and a seal attached to the first and second upper surfaces.

In some embodiments, an adapter for a beverage flavoring applicator may include a top surface having a center and an aperture offset from the center; a hollow boss extending from the top surface about the aperture, the boss including an open mouth on an upper portion of the boss, the open mouth being generally aligned with the aperture, wherein the boss is configured to mate with a beverage flavoring applicator; and a skirt extending downward from an outer edge of the top surface, wherein the skirt is configured to accept an upper end of a beverage can such that the mouth and the aperture are generally aligned with an opening of the beverage can.

In some embodiments, a beverage flavoring applicator and adapter may include a housing having an internal channel; a cup assembly disposed in the internal channel, the cup assembly including a first chamber having a first flavoring substance and a second chamber having a second flavoring substance, wherein the first flavoring substance is positioned above the second flavoring substance; a plunger slidably engaged with the housing, the plunger having a spike configured to rupture the first and second chambers upon movement of the plunger from a retracted position to a deployed position with respect to the housing; and an adapter having a top surface with an aperture therethrough, an open boss extending upwardly from the top surface about the aperture, and an open skirt extending downwardly from the top surface, the skirt being configured to mate with a top portion of a beverage can; wherein the boss is configured to accept the first and second flavoring substances from the internal channel and direct the first and second flavoring substances onto the beverage can.

In some embodiments, a beverage flavoring applicator may include a housing having an internal channel; a cup assembly disposed in the internal channel, the cup assembly including a chamber having a flavoring substance therein; a plunger slidably engaged with the housing, the plunger having a spike configured to rupture the chamber of the cup assembly upon movement of the plunger from a retracted position to a deployed position with respect to the housing, the plunger further including a bottle opener wherein the bottle opener includes: a wall extending from a cylindrical body of the plunger; a cavity located between the wall and the cylindrical body; a first nub extending partway into the cavity from the cylindrical body; and a second nub positioned opposite the first nub and extending partway into the cavity from the wall; wherein the first and second nubs are positionable about a bottle cap such that one of the first and second nubs is engaged with a lower edge of the bottle cap and the other of the first and second nubs is engaged with a top surface of the bottle cap so as to facilitate application of pressure to the bottle cap and thereby remove the bottle cap from the bottle.

In some embodiments, a method of using a beverage flavoring applicator may include loading a cup assembly into a housing, the cup assembly including a first cup having a first chamber with a first flavoring substance disposed in the first chamber, and a second cup having a second chamber with a second flavoring substance disposed in the second chamber, the first and second cups being nested one within the other; mounting a plunger to the housing, the plunger having a spike therein, the plunger being slidably engaged with the housing; placing the housing on a beverage container; and moving the plunger from a first position to a second position with respect to the housing such that the spike ruptures the first and second cups thereby dispensing the first and second flavoring substances into or onto the beverage container.

In some embodiments, a method of making a cup assembly for a beverage flavoring applicator may include loading a first flavoring substance into a first cup; placing a second cup into the first cup, the second cup having a volume smaller than the first cup; loading a second flavoring substance into the second cup; and applying a seal to at least one of the first and second cups thereby sealing at least one of the first and second flavoring substances within the cup assembly.

DETAILED DESCRIPTION

Figure 1:
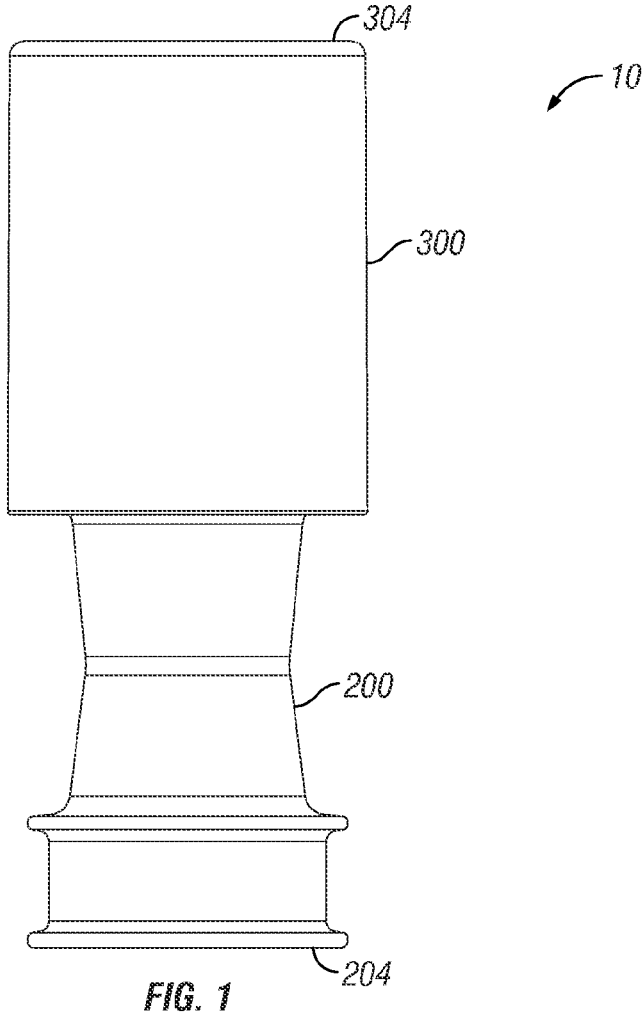
FIG. 1 is a side view of one embodiment of a flavoring applicator shown in a retracted position.

As used herein, the following terms should be understood to have the indicated meanings:

When an item is introduced by "a" or "an," it should be understood to mean one or more of that item.

"Annular" means ring-shaped and may involve any suitable shape of ring, including but not limited to circular, oval, polygonal, irregular, or a combination thereof.

"Beverage" means any drinkable liquid or semi-liquid, including for example flavored water, soft drinks, fruit drinks, coffee-based drinks, tea-based drinks, juice-based drinks, milk-based drinks, gel drinks, carbonated or non-carbonated drinks, alcoholic or non-alcoholic drinks, or a combination thereof.

"Boss" means a projection extending from a surface of an object. A boss may have any desired size and shape.

"Cavity" means a hollow space.

"Chamber" means a space that is at least partially enclosed.

"Channel" means a pathway through which solid, liquid, or gaseous materials, or a combination thereof, may pass.

"Comprises" means includes but is not limited to.

"Comprising" means including but not limited to.

"Cup" means a generally hollow container having an opening through which one or more substances may be placed in the container. Such opening may be left open or may be closed with a seal or other suitable cover. A cup may have any suitable size and shape.

"Flavoring substance" means any consumable substance that can be added to a beverage. A flavoring substance may be solid, liquid, gaseous, or a combination thereof. A flavoring substance may or may not involve flavor, carbonation, texture, or a combination thereof.

"Having" means including but not limited to.

"Hollow" means having a cavity within.

"Ledge" means an edge, a surface, or a combination of one or more edges, surfaces, or both edges and surfaces. A ledge may have any desired size, shape, texture, orientation, or other attribute.

"Nested" means forming a sequence with each member thereof at least partially containing or contained in the next.

"Nub" means a protrusion. A nub may have any suitable size and shape.

"Protrusion" means a portion of a structure that projects away from an adjacent portion of the structure. A protrusion may have any suitable size and shape.

"Seal" means a covering that may or may not be completely airtight or watertight.

Referring to FIGS. 1-19, in order to facilitate the clean and accurate distribution of consistent quantities of flavoring substances 102, 103 into or onto a bottle 12, can 12*a*, or other beverage container, a flavoring applicator 10 may have three main components: (1) a cup assembly 100 with one or more quantities of one or more flavoring substances 102, 103 disposed therein; (2) a housing 200 for holding cup assembly 100 in a substantially static position over the beverage container; and (3) a plunger 300 shaped in a complementary manner to housing 200 such that plunger 300 may slidably move with respect to housing 200. Plunger 300 may have a spike 302 disposed therein for piercing, puncturing or rupturing cup assembly 100 in order to dispense one or more of flavoring substances 102, 103 into or onto bottle 12, can 12*a*, or other beverage container. By way of non-limiting example, the component parts of flavoring applicator 10 may be made out of plastic, such as high-density polyethylene plastic or food-grade plastic, glass, fiberglass, rubber, aluminum, stainless steel or other metal, or any other suitable material. For example, in some embodiments, cups 114, 115 of cup assembly 100 may be made of FDA-approved APET plastic about 0.015-inch thick, which may be clear or colored. Components of flavoring applicator 10 may have a variety of wall thicknesses and may or may not be disposable. Additionally, although components of the flavoring applicator 10 are shown having generally circular cross-sectional shapes, the components may have any desired shape which is compatible with the corresponding beverage container with which flavoring applicator 10 may be used.

Figure 2:
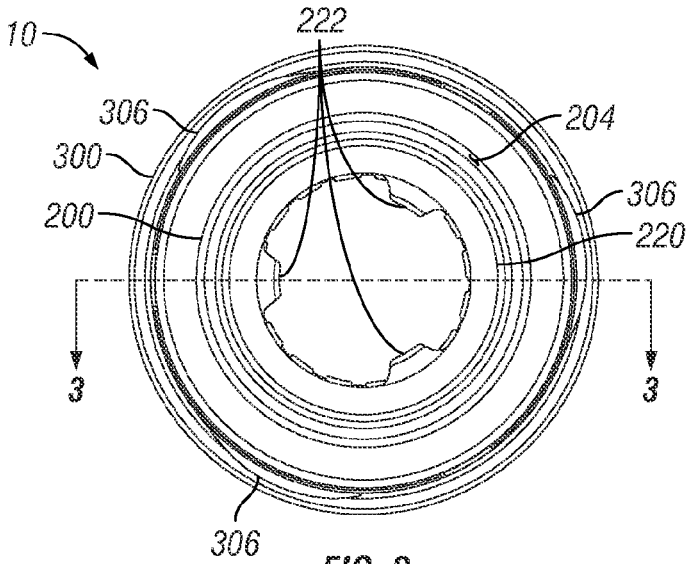
FIG. 2 is a bottom view of the flavoring applicator of FIG. 1.
Figure 3:
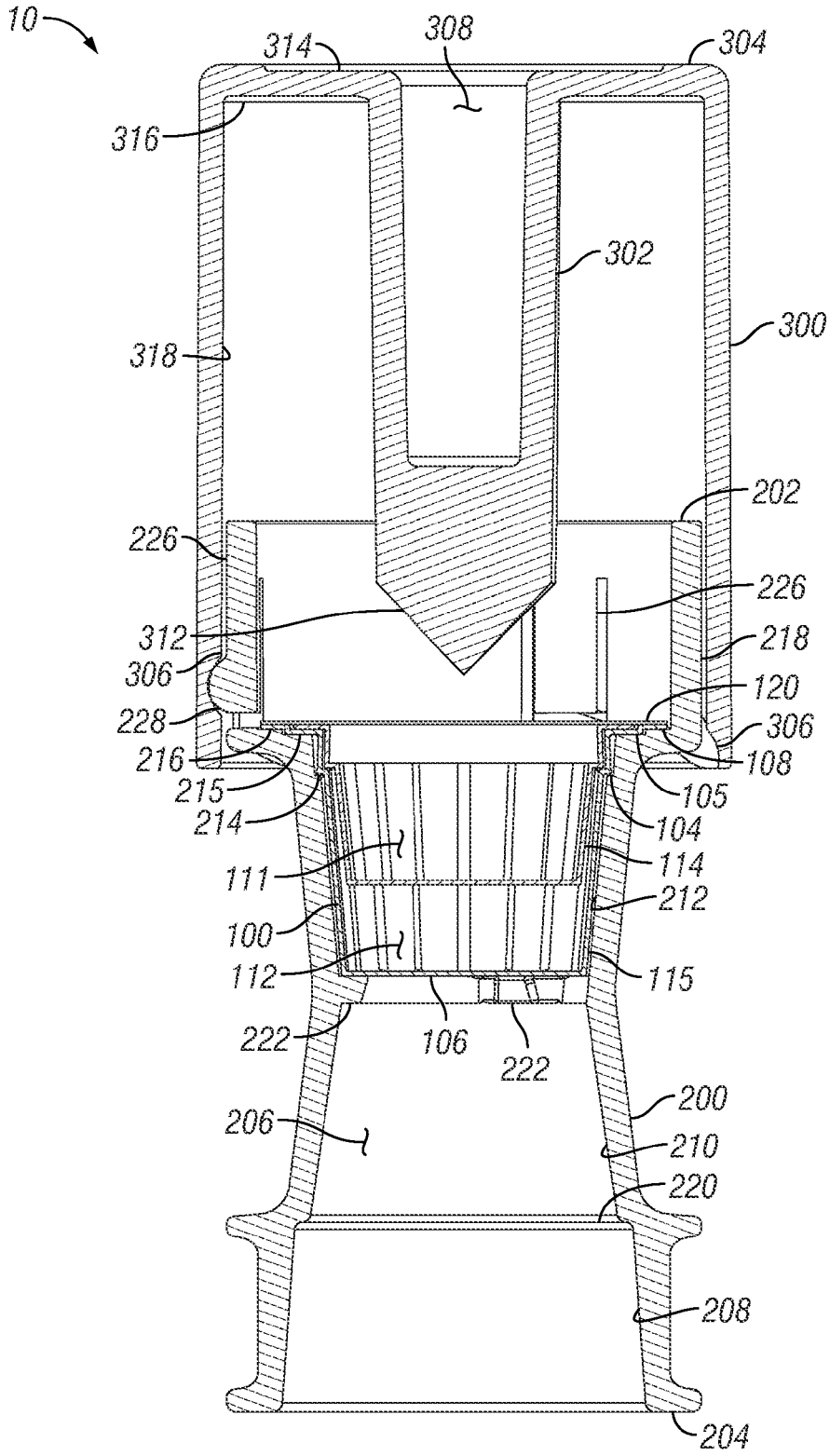
FIG. 3 is an enlarged cross-sectional view of the flavoring applicator of FIG. 1 taken in the direction of arrows 3-3 of FIG. 2.
Figure 4:
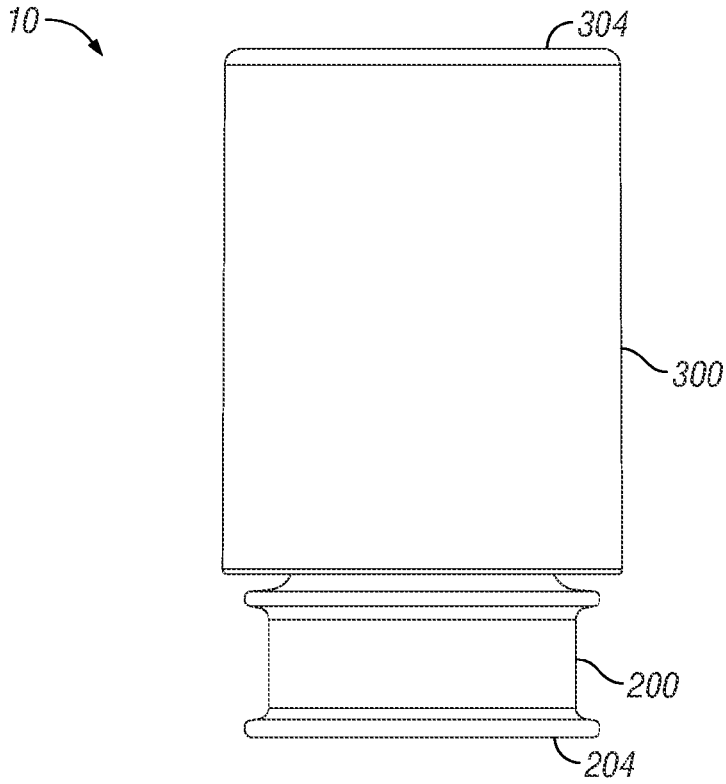
FIG. 4 is a side view of the flavoring applicator of FIG. 1 shown in a deployed position.
Figure 5:
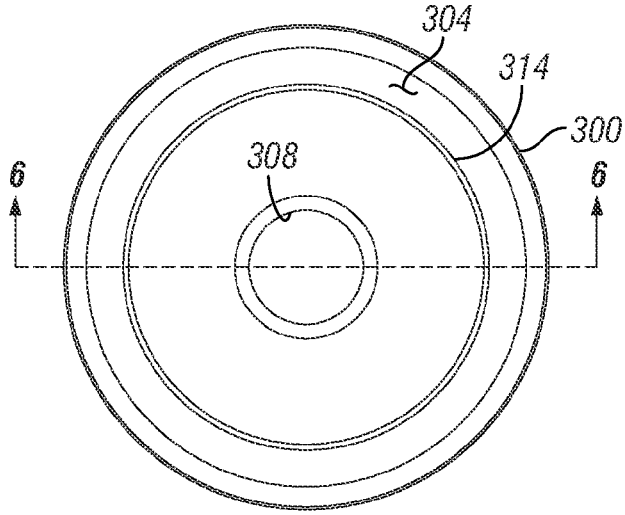
FIG. 5 is a top view of the flavoring applicator of FIG. 1.
Figure 6:
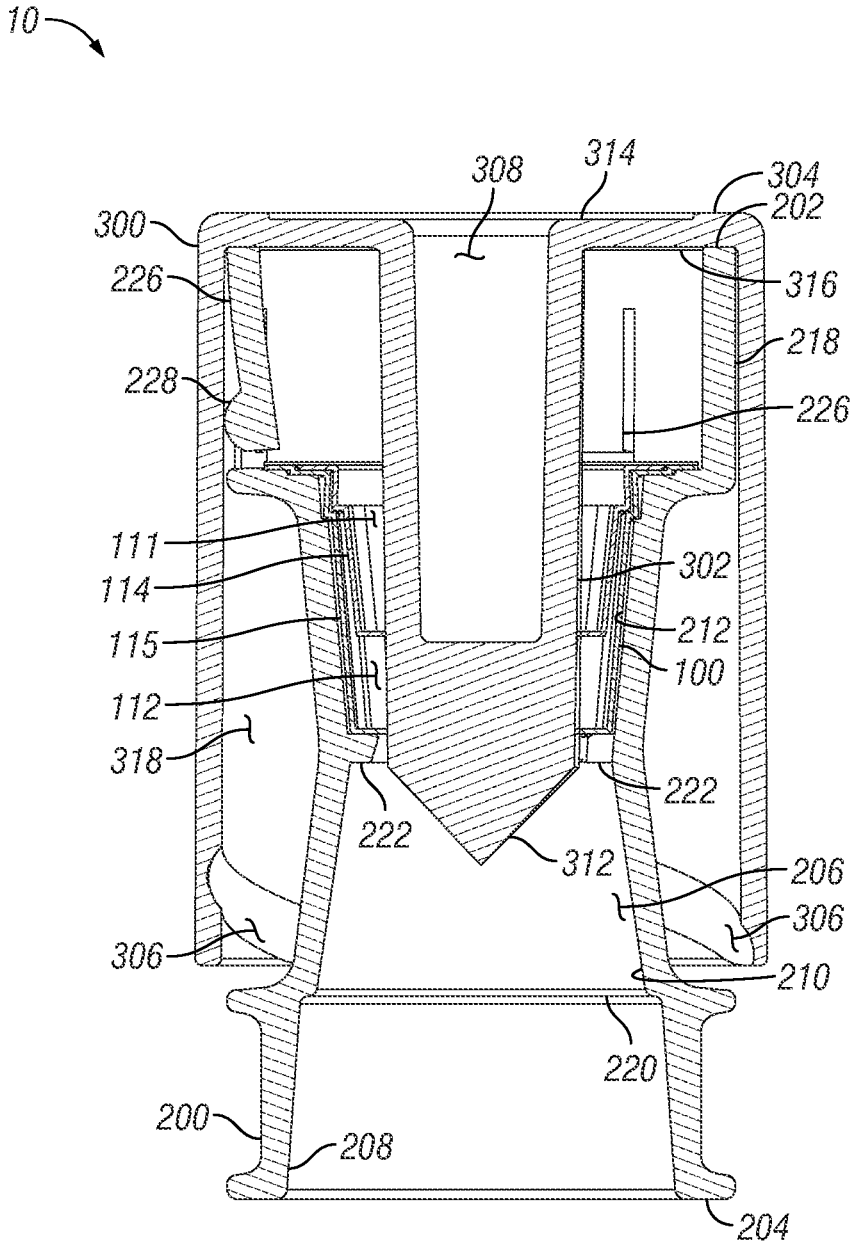
FIG. 6 is an enlarged cross-sectional view of the flavoring applicator of FIG. 1 taken in the direction of arrows 6-6 of FIG. 5 and shown in the deployed position of FIG. 4.

As shown in FIGS. 1-4, 6, 12-13 and 15-16, housing 200 may have an open crown 218 and an open base 204 with an internal channel 206 extending through housing 200 from base 204 through crown 218. As illustrated in FIGS. 3 and 6, starting from base 204 of housing 200, a lower portion 208 of internal channel 206 may be sized and shaped to engage with a neck 14, 14*a* of bottle 12, can 12*a*, or other beverage container and may have a frustoconical shape. A middle portion 210 of internal channel 206 may be sized and shaped to act as a conduit for flavoring substances 102, 103 while they travel from cup assembly 100 to a mouth 26, 26*a* of bottle 12, can 12*a* or an entry point of any other beverage container. In the embodiment of FIGS. 3 and 6, middle portion 210 of internal channel 206 is also frustoconical in shape, but in other embodiments middle portion 210 of internal channel 206 may be in any suitable shape. An upper portion 212 of internal channel 206 may be sized and shaped to receive cup assembly 100 and, in some embodiments, may have a frustoconical shape. Additionally, crown 218 of housing 200 may be sized and shaped to slidably engage an interior wall surface 318 of plunger 300.

Figure 7:
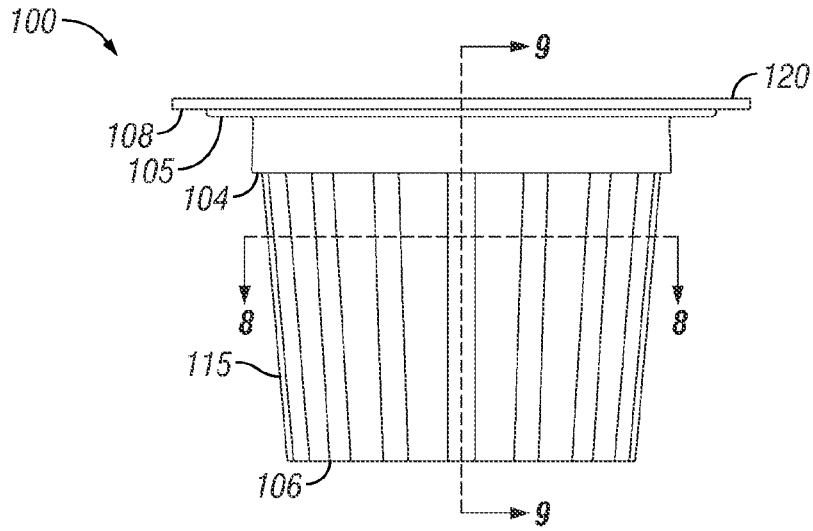
FIG. 7 is a side view of a cup assembly for use in the flavoring applicator of FIG. 1.
Figure 9:
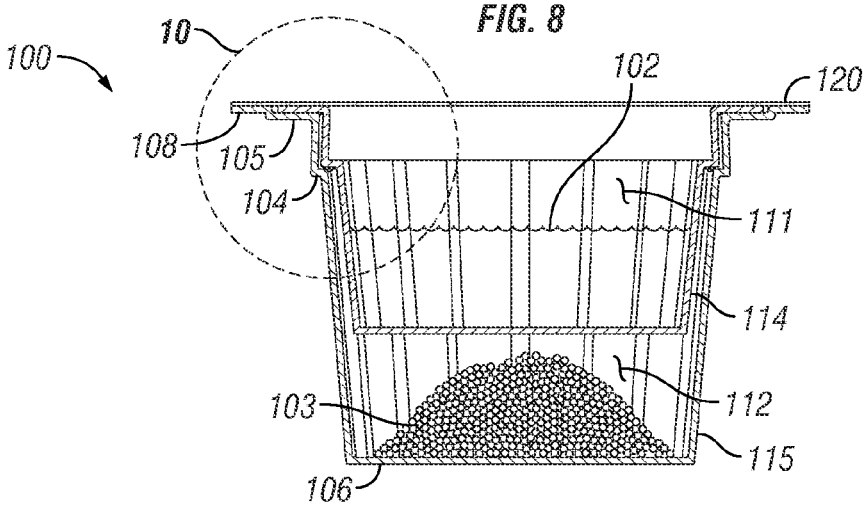
FIG. 9 is a cross-sectional view of the cup assembly of FIG. 7 taken in the direction of arrows 9-9 of FIG. 7.
Figure 10:
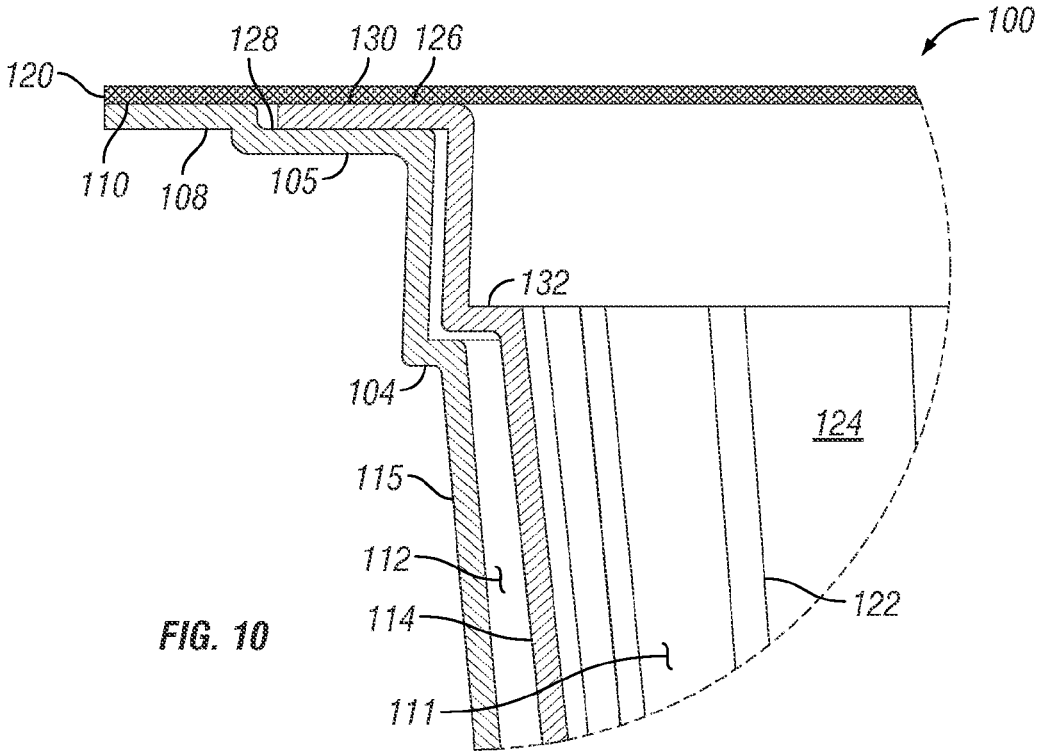
FIG. 10 is an enlarged cross-sectional view of the area within circular cross-sectional line 10 of FIG. 9.
Figure 11:
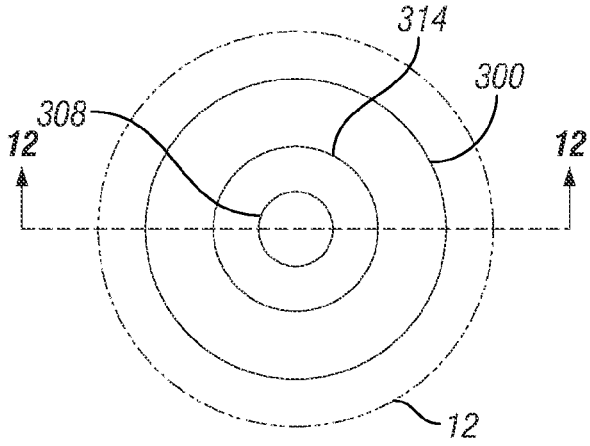
FIG. 11 is a top view of the flavoring applicator of FIG. 1 installed on a beverage bottle.

Upper portion 212 of internal channel 206 may comprise the section of internal channel 206 between crown 218 and middle portion 210 and may be open at its connection to crown 218 and at its connection to middle portion 210 such that it can receive cup assembly 100 through crown 218 and allow flavoring substances 102, 103 in cup assembly 100 to exit upper portion 212 into middle portion 210. In some embodiments, housing 200, and particularly upper portion 212 of internal channel 206, may be configured to hold cup assembly 100 in a substantially fixed position with respect to housing 200 and may be sized and shaped such that cup assembly 100 fits within internal channel 206 and generally rests on mating surfaces of internal channel 206. As shown in FIG. 3, upper portion 212 may include a series of annular ledges 214, 215, 216 near the junction of upper portion 212 of internal channel 206 and crown 218 of housing 200. The series of annular ledges 214, 215, 216 may be configured to accept a corresponding series of shoulders 104, 105 and a flange 108 of cup assembly 100 (as best shown in FIGS. 7, 9, and 10), thus holding cup assembly 100 in a substantially static position within internal channel 206. In some embodiments, shoulder 104 is disposed in annular ledge 214, shoulder 105 is disposed in annular ledge 215, and flange 108 is disposed in annular ledge 216. In other embodiments, upper portion 212 of internal channel 206 may not have any annular ledges, or it may include any number of annular ledges or other features which are configured to mate with a corresponding number of shoulders, flanges, or other features of cup assembly 100. Although upper portion 212 and other portions 208, 210 of internal channel 206 are shown in a series of generally frustoconical shapes, upper portion 212 and other portions 208, 210 of internal channel 206 may be shaped in any other desired shape, and corresponding shape changes may be applied to cup assembly 100.

At the junction of upper portion 212 and middle portion 210, internal channel 206 may also include one or more internal protrusions 222, as best shown in FIGS. 2-3, for supporting cup assembly 100. Internal protrusions 222 may protrude from a surface of internal channel 206 and may be spaced about a circumference or perimeter of internal channel 206. Internal protrusions 222 may extend into a center area of internal channel 206 without blocking internal channel 206 so that flavoring substances 102, 103 may still pass by internal protrusions 222. While three protrusions 222 are shown in FIGS. 2-3, internal channel 206 may include any suitable number of protrusions 222. In some embodiments, protrusions 222 may contact a base 106 of cup assembly 100 when cup assembly 100 is placed in housing 200 and may help to hold cup assembly 100 in a substantially static position with respect to housing 200. Additional elements may function together to hold cup assembly 100 in place. In some embodiments, upper portion 212 of internal channel 206 may itself contact cup assembly 100 to hold cup assembly 100 in a substantially static position. In some embodiments, cup assembly 100 may be held in a substantially static position by one or more of internal protrusions 222, upper portion 212 of internal channel 206, and annular ledges 214, 215, 216.

Figure 12:
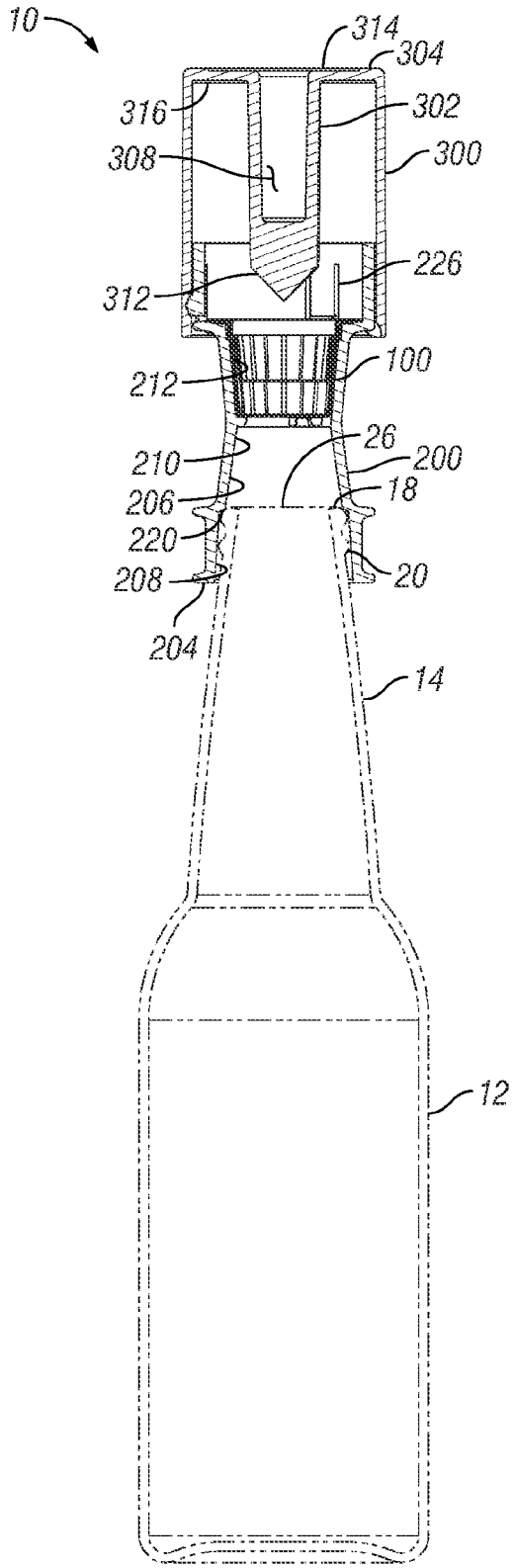
FIG. 12 is a cross-sectional view of the flavoring applicator and bottle of FIG. 11 taken in the direction of arrows 12-12 of FIG. 11.

Lower portion 208 of internal channel 206 may be connected to a lower end of middle portion 210 of internal channel 206 and may terminate at base 204 of housing 200. In some embodiments, lower portion 208 may be configured to receive one or more of a rim 18, ridges 20 and a portion of neck 14 of bottle 12 (see FIG. 12). As such, in some embodiments, lower portion 208 may be sized and shaped to receive a standard sized bottle mouth 26 in order to hold housing 200 in a substantially static position with respect to bottle 12. Lower portion 208 of internal channel 206 may be tapered and substantially smooth for engagement with neck 14 of bottle 12. Alternatively, lower portion 208 of internal channel 206 may have one or more threads, grooves, ribs, protrusions, or a combination thereof, such that housing 200 may be firmly attached to neck 14 of bottle 12 having a complementary engagement structure. Although housing 200 is shown in FIG. 12 installed on a beverage bottle 12, persons of ordinary skill in the art will understand that base 204 of housing 200 may be configured or adapted to receive, be attached to, or be installed on a can 12*a*, a jug, a cup, or any other beverage container. Although a female embodiment of housing base 204 and lower portion 208 of internal channel 206 is shown, male embodiments of housing base 204 and lower portion 208 of internal channel 206 may be provided, if desired. In some embodiments, internal channel 206 may include a lower ledge 220 at an intersection between middle portion 210 and lower portion 208 of internal channel 206. Lower ledge 220 may contact rim 18 of bottle 12 when bottle 12 is inserted into lower portion 208 to serve as a stop and further help hold flavoring applicator 10 in a substantially stable position over bottle 12.

Figure 14:
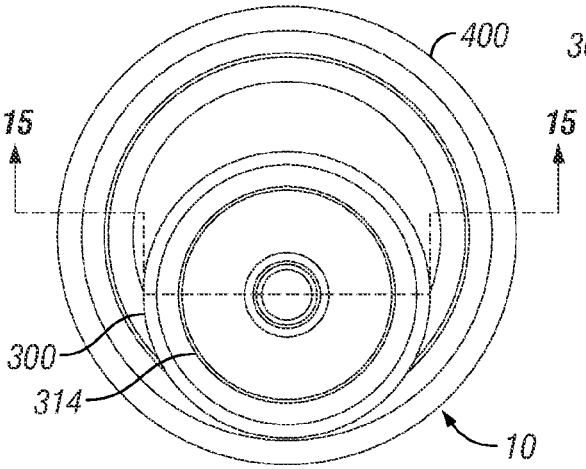
FIG. 14 is a top view of the flavoring applicator of FIG. 1 and an adapter for use with a can.
Figure 15:
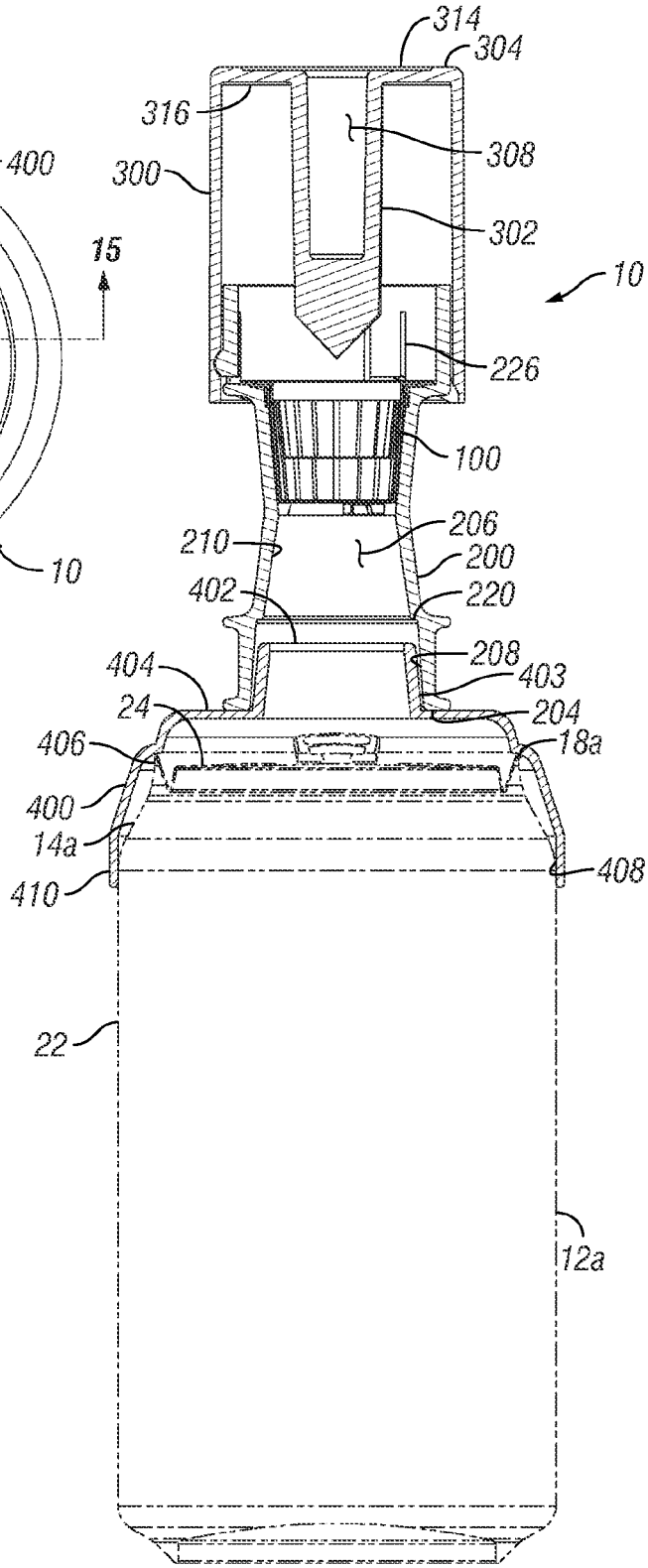
FIG. 15 is a cross-sectional view of the flavoring applicator and adapter of FIG. 14 installed on a beverage can taken in the direction of arrows 15-15 of FIG. 14.
Figure 16:
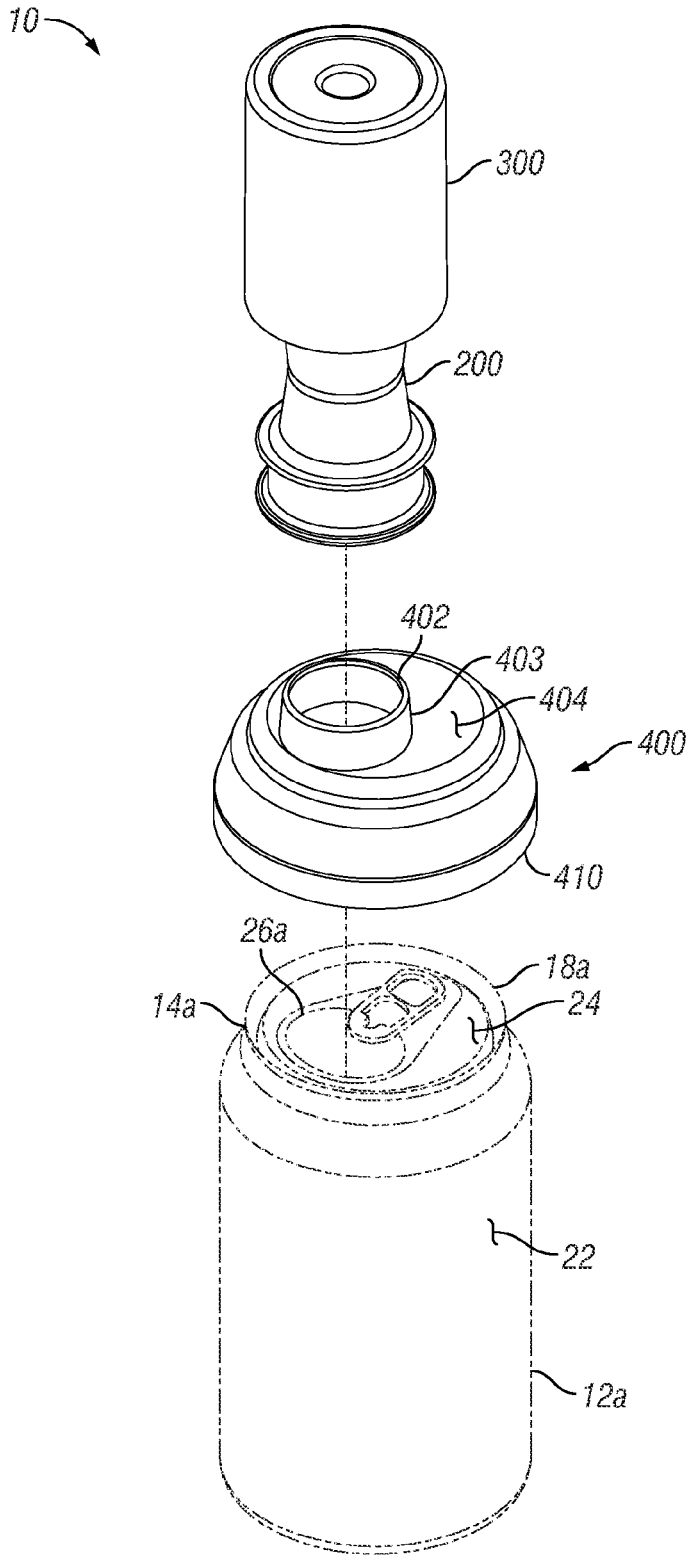
FIG. 16 is an exploded perspective view of the flavoring applicator, adapter, and beverage can of FIG. 15.

In other embodiments, shown in FIGS. 14-16, lower portion 208 of internal channel 206 may be configured to mate with an adapter 400. In some embodiments, adapter 400 may include a mouth 402 configured to receive flavoring substances 102, 103 from internal channel 206, a hollow boss 403 connecting mouth 402 to an aperture in a top surface 404, a ledge 406 configured to contact a rim 18*a* of can 12*a*, and a skirt 410 configured to contact an exterior surface 22 of can 12*a*. As shown in FIGS. 15 and 16, the aperture in top surface 404 may be directly below mouth 402. Both the aperture and mouth 402 may be located in an off-center position with respect to top surface 404 such that the aperture and mouth 402 may generally align with mouth 26*a* of can 12*a* when adapter 400 is applied to can 12*a*. Boss 403 may extend from top surface 404 of adapter 400 and may be shaped to fit within lower portion 208 of internal channel 206. In some embodiments, a friction fit may exist between boss 403 and lower portion 208 of internal channel 206. Top surface 404 of adapter 400 may extend laterally from boss 403 and may act as a contact surface for base 204 of housing 200 when housing 200 is applied to adapter 400. Skirt 410, which may extend downward from an outer periphery of top surface 404, may curve downwardly to a maximum diameter just larger than the diameter of a typical can 12*a*, and may fit over an exterior surface 22 of can 12*a* with a friction fit.

In use, skirt 410 of adapter 400 may be fitted over can 12*a* such that exterior surface 22 of can 12*a* contacts an interior wall 408 of skirt 410. In some embodiments, adapter 400 may be moved until a ledge 406 of adapter 400 contacts a rim 18*a* of can 12*a*. Adapter 400 may be rotated if and as needed until mouth 402 of adapter 400 is positioned over mouth 26*a* of can 12*a*, as shown in FIG. 16. Flavoring applicator 10 may be applied to adapter 400 by aligning lower portion 208 of internal channel 206 with mouth 402, as shown in FIG. 16, and pressing flavoring applicator 10 onto adapter 400 until base 204 of housing 200 contacts top surface 404 of adapter 400. In some embodiments, lower portion 208 of housing 200 and boss 403 of adapter 400 may form a friction fit when flavoring applicator 10 is applied to adapter 400. Thus, when housing 200 is removed from can 12*a*, adapter 400 may remain attached to housing 200. Alternatively, a clearance fit may be employed between housing 200 and adapter 400, and/or between adapter 400 and can 12*a*.

Crown 218 of housing 200 may be configured to contact and slidably move within interior wall surface 318 of plunger 300. As shown in FIGS. 2-3, 6, 12-13 and 15, crown 218 may be generally cylindrical and may connect with upper portion 212 of internal channel 206. Crown 218 may be open to receive cup assembly 100 therethrough for loading cup assembly 100 into upper portion 212 of internal channel 206. Crown 218 may include one or more flexible tabs 226 spaced peripherally about crown 218. Each flexible tab 226 may include a protrusion 228 at a distal end of flexible tab 226, as best shown in FIGS. 3 and 6. In some embodiments, protrusions 228 of flexible tabs 226 may be configured to mate with corresponding internal threads 306 disposed on interior wall surface 318 of plunger 300 so that plunger 300 can initially be screwed onto housing 200. Threads 306 may be configured for clockwise or counterclockwise twisting motion of plunger 300 with respect to housing 200, and threads 306 may be configured for a partial turn (such as a one-third turn, as shown, for example), a full turn, or more than a full turn. Flexible tabs 226 may also permit protrusions 228 to leave threads 306 when downward force is applied to plunger 300 to force it to the deployed position, as shown in FIG. 6. The movement and flexing of flexible tabs 226 may allow protrusions 228 to rest on interior wall surface 318 of plunger 300, as shown in FIG. 6, and also may cause protrusions 228 to spring outwardly when protrusions 228 align with threads 306 or when housing 200 is removed from plunger 300. Thus, as plunger 300 is retracted from the deployed position with respect to housing 200, flexible tabs 226 may again engage threads 306 and cause plunger 300 to stay connected with housing 200. Plunger 300 may be twisted off from housing 200 as protrusions 228 are disengaged from internal threads 306. Although threads 306 are shown on plunger 300 and protrusions 228 are shown on housing 200, an opposite configuration may be employed in which one or more protrusions may be on plunger 300 for engaging one or more threads on housing 200.

As shown in FIGS. 1, 3, 4-6, and 11-19, plunger 300 may have a top portion 304, a spike 302 extending downward from an interior ceiling 316 of top portion 304, and at least one internal thread 306 disposed on interior wall surface 318. Spike 302 may be disposed within plunger 300, extending from top portion 304 substantially vertically downward through plunger 300. Spike 302 may be configured such that it extends through internal channel 206 of housing 200 a sufficient distance to pierce cup assembly 100 placed within housing 200 when plunger 300 is moved from the retracted position to the deployed position, thereby dispending flavoring substances 102, 103 into bottle 12, can 12*a*, or other container. In some embodiments, interior ceiling 316 of top portion 304 of plunger 300 may serve as a stop via engagement with upper edge 202 of housing 200 to limit further relative movement of plunger 300 with respect to housing 200. Although spike 302 is shown with a generally cylindrical body 322, spike 302 may be any suitable shape that fits within internal channel 206 of housing 200.

Figure 17:
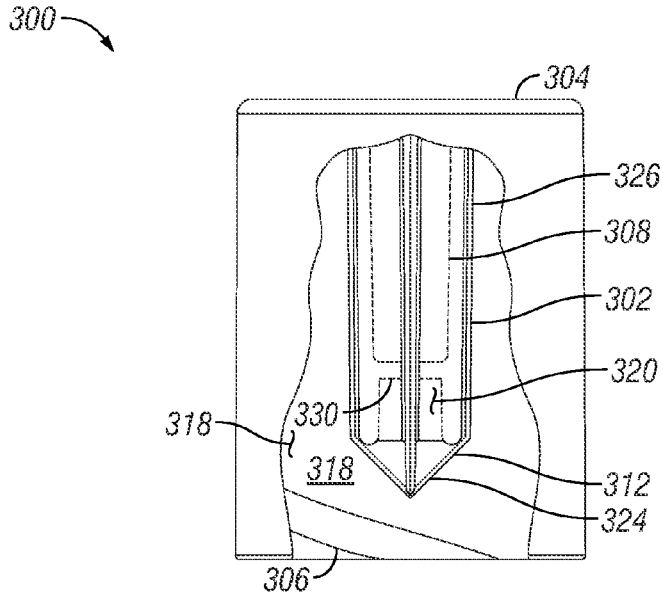
FIG. 17 is a cut-away side view of the plunger of the flavoring applicator of FIG. 1.
Figure 18:
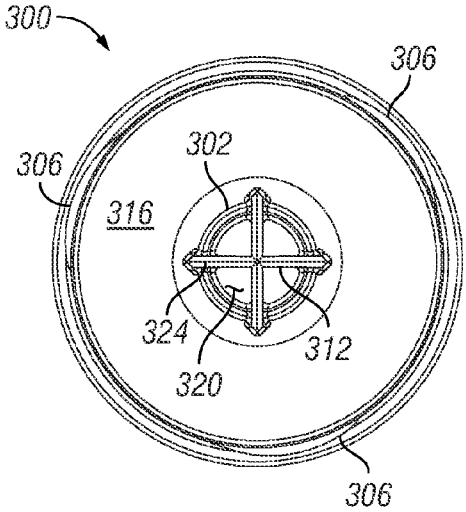
FIG. 18 is a bottom view of the plunger of the flavoring applicator of FIG. 1.
Figure 19:
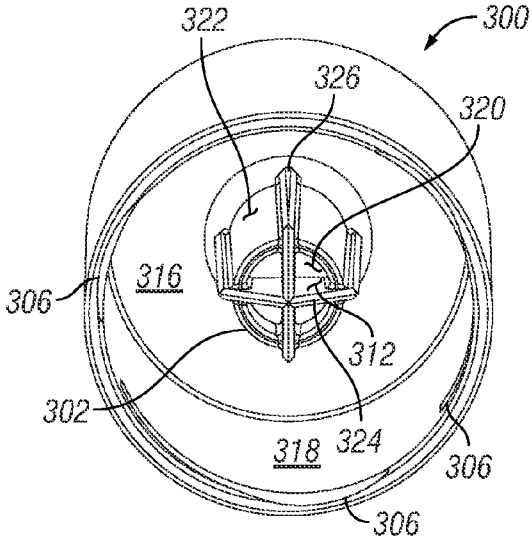
FIG. 19 is a bottom perspective view of the plunger of the flavoring applicator of FIG. 1.
Figure 20:
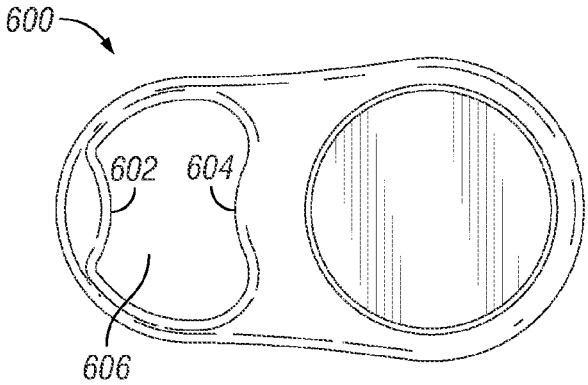
FIG. 20 is a top view of an alternative embodiment of a flavoring applicator having a bottle opener.
Figure 21:
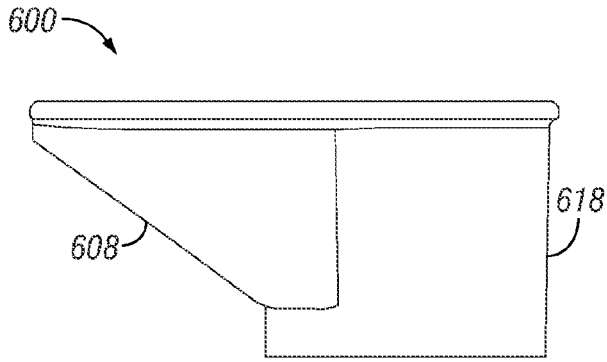
FIG. 21 is a front view of the flavoring applicator of FIG. 20.
Figure 22:
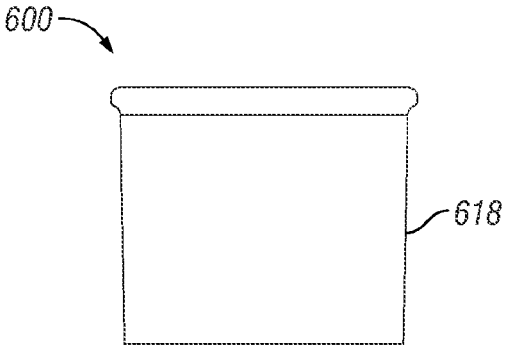
FIG. 22 is a right side view of the flavoring applicator of FIG. 20.
Figure 23:
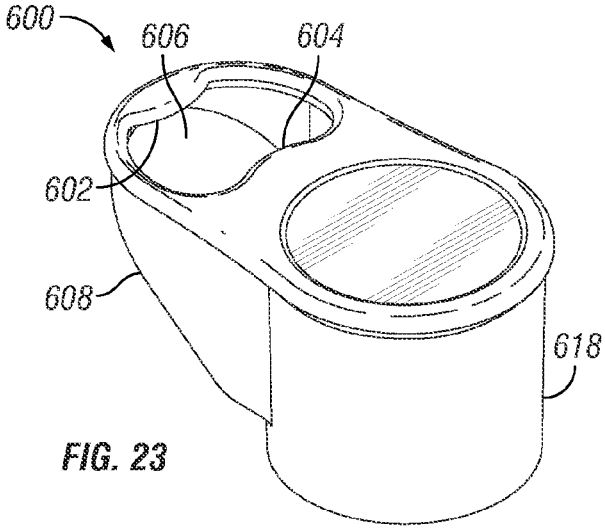
FIG. 23 is a perspective view of the flavoring applicator of FIG. 20.

As best shown in FIGS. 17-19, spike 302 may include one or more blades 312 and a wall 330. In the embodiment of FIGS. 17-19, four blades 312 intersect at a central axis of plunger 300. Wall 330 intersects the four blades 312 at a substantially perpendicular plane, thus separating a central cavity 308 of spike 302 from compression chambers 320 of spike 302. In some embodiments, compression chambers 320 may form pressurized air therein during at least a portion of the movement of plunger 300 as spike 302 is engaged with cup assembly 100 and plunger 300 is forced into the deployed position. The pressurized air may more forcefully expel flavoring substances 102, 103 from flavoring applicator 10. In some embodiments, spike 302 may comprise a generally cylindrical body 322 which is separated into lour quadrants by the four blades 312. Each blade 312 may contain a blade edge 324 which may be sufficiently sharp to puncture and/or cut seal 120 and cups 114, 115. Each blade 312 may also contain an upper blade section 326 which extends up cylindrical body 322 of spike 302 from wall 330 to interior ceiling 316 of top portion 304. Plunger 300 may also include a recess 314 on top portion 304 of plunger 300, as best shown in FIG. 3. Recess 314 may encircle central cavity 308 of spike 302 and may provide a suitable location for the addition of a sticker or other label to plunger 300.

Turning now to cup assembly 100, in some embodiments, as shown in FIGS. 3, 6-10, 12-13, and 15, cup assembly 100 may include a cup 114 and a cup 115. Cup assembly 100 may be closed at its base 106 and sealed at its top at flange 108. Alternatively, cup assembly 100 may be open at its top at flange 108. By way of non-limiting example, cup assembly 100 may include a seal 120 fastened to cups 114, 115 by heat sealing, electrostatic sealing, adhesive, or other suitable sealing with foil, wax paper, plastic, or other thin sheet material. In some embodiments, as best seen in FIG. 10, seal 120 may contact an upper surface 110 of flange 108 of cup 115 and an upper surface 130 of cup 114, thus sealing both cups 114, 115 with a single seal 120. Alternatively, seal 120 may be attached only to one or the other of cups 114, 115. For example, cup 114 may be sealed with seal 120, and cup 115 may be effectively sealed by cup 114 being press fit into cup 115. In some embodiments, ridges 116, 122 (discussed further below) may help facilitate such a press fit.

In some embodiments, cup 115 may have a shape that is generally complementary to upper portion 212 of internal channel 206 of housing 200. Cup 115 and cup 114 may have one or more shoulders, flanges, recesses or ledges which allow cup 115 and cup 114 to fit together. As best shown in FIG. 10, in some embodiments, cup 115 may include flange 108 which may include recess 128. In some embodiments, flange 126 of cup 114 may be disposed in recess 128. In this manner, upper surface 130 of cup 114 and upper surface 110 of flange 108 of cup 115 may more easily be aligned and made substantially flush with one another, thus allowing cups 114, 115 to share a common seal 120. Alternatively, each cup 114, 115 may have its own seal 120, and flanges 126 and 108 of cups 114 and 115 may or may not be substantially flush with one another and may or may not be located at the top ends of cups 114 and 115. For example, upper surface 130 may be above or below upper surface 110, and the one or more seals 120 and upper surfaces 110, 130 may or may not be substantially flat. In some embodiments, cup 114 may be sealed by applying a seal to flange 126, while flange 108 may not be sealed, and flavoring substances 102, 103 contained within cup 115 may be sealed within cup 115 by a friction fit between an internal surface of cup 115 and an external surface of cup 114. In some embodiments, cup 114 may or may not include flange 126 or shoulder 132, and cup 114 may nest completely within cup 115. Cup 114 and cup 115 may be sealed by either applying a separate seal to each of cup 114 and cup 115 or by applying seal 120 to flange 108, either alone or in conjunction with a friction fit between an internal surface of cup 115 and an external surface of cup 114. Additionally, ledge 132 of cup 114 may align with shoulder 104 of cup 115 so that, in some embodiments, sufficient space is retained between ledge 132 and shoulder 104 so that the only point of contact between cup 114 and cup 115 is between flange 126 and recess 128. Further, by way of non-limiting example, cup assembly 100 may be similar in shape and size to the small plastic cups commonly used for coffee creamers. Additionally, cups 114, 115 may be constructed of a material similar to that of a coffee creamer cup so that the material is easily punctured but yet is not so brittle as to break apart and fall into bottle 12. In some embodiments useful in connection with standard 12-ounce beer bottles, cup 114 may have a base of about 0.75-inch diameter, a mouth of about 0.875-inch diameter, a flange 126 of about 1.0-inch outer diameter, a height of about 0.5 inch, and an internal volume of about 0.23 in.$^3$; and cup 115 may have a base of about 0.77-inch diameter, a mouth of about 0.92-inch diameter, a flange 108 of about 1.27-inch outer diameter, a height of about 0.8 inch, and an internal volume of about 0.38 in.$^3$.

Cups 114 and 115 may include chambers 111 and 112, respectively, which may each hold a quantity of flavoring substance 102, 103 or several different types of flavoring substances. Flavoring substances 102, 103 may be the same or different. In some embodiments, separate chambers 111 and 112 may be useful to keep flavoring substances 102 and 103 separate until cup assembly 100 is ruptured. As shown in FIG. 9, chamber 111 may hold a liquid flavoring substance 102 such as water, while chamber 112 may hold a dry solid flavoring substance 103 such as a flavoring powder or crystals. By way of non-limiting example, as illustrated in FIG. 9, cup assembly 100 may have two nested cups 114, 115, one containing a flavoring substance 103, such as a quantity of salt, and the other containing a flavoring substance 102, such as a quantity of lime juice. In some embodiments, the salt may be contained in either of cups 114, 115, and the lime juice may be contained in either of cups 114, 115. In some embodiments, more than one flavoring substance may be in the same cup 114 or 115. Of course, any other desired flavoring substances 102, 103 may be used, such as Worcestershire sauce, pepper, lemon juice, orange juice, tomato juice, and/or michelada mix, for example. Flavoring substances 102, 103 are not shown in all figures for the sake of clarity of the figures.

With respect to beer beverages to be "dressed" with salt and lime flavorings, testing was conducted to observe the results of incorporating different flavoring substances, different quantities of each flavoring substance, and different positioning of each flavoring substance in cup 114 and cup 115. Sample beverages included 12-ounce bottles of Corona Extra™, Corona Extra Light™, Imperial™, Tecate™, Tecate Light™, Carta Blanca™, Sol™, Pacifico™, Modelo Especial™, Dos Equis™, Land Shark™, and Victoria™ brand Mexican beers. Flavoring substances tested included H-E-B® brand squeezed lime juice available from H-E-B Central Market (San Antonio, Tex.), Santa Cruz™ organic lime juice available from Santa Cruz Natural, Inc. (Orrville, Ohio), ReaLime™ brand bottled lime juice available from Dr. Pepper Snapple Group Inc. (Plano, Tex.), fresh squeezed lime juice, True Lime™ dehydronated lime flavoring crystals available from True Citrus (Baltimore, Md.), coarse flake variety salt available from Cargill Inc. (Minneapolis, Minn.), sea salt available from Cargill Inc., Antifoam A Compound available from Dow Corning Corporation (Midland, Mich.), and CD-2020 powdered silicone antifoam available from New London Chemicals, Inc. (Lakeland, Fla.). Tests performed included lime taste tests, salt taste and appearance tests, and general taste and appearance tests. Additionally, to reduce the risk of excess foaming and foam expansion over mouth 26 of bottle 12 or other beverage container, foaming quantity and rate tests were conducted using various flavoring substances, ratios of flavoring substances, and anti-foaming agents.

For some beverages, such as beer, with which salt is used as a flavoring substance, it was discovered that the type and manufacture of salt may determine the coarseness of the salt grains, the taste of the salt, the prominence of the salt taste, the overall appearance of the salt, the ability of some of the salt to remain on rim 18 of bottle 12 or top surface 24 of can 12*a*, and the amount of foaming caused by the salt. Salt included in flavoring substances 102, 103 may include table salt, iodized salt, rock salt, kosher salt, coarse flake variety salt, sea salt, or any other type of salt. In some embodiments, flavoring substances 102, 103 may include salt with an average grain size greater than about 210 microns, which may increase the salt taste, increase the ability of the salt to remain on rim 18 or top surface 24, and minimize foaming caused by addition of flavoring substances 102, 103. In some embodiments, flavoring substances 102, 103 may include sea salt with an average grain size between about 420 and about 840 microns. In some embodiments, using a sea salt with an average grain size between about 420 and about 840 microns may decrease foaming and/or foaming rate of the beverage and may also increase salt taste while using less sea salt. In some embodiments, the use of sea salt in flavoring substances 102, 103 may allow for the addition of less salt to flavoring substances 102, 103 while increasing salt taste and salt retention on rim 18 or top surface 24. In some embodiments, if the amount of salt in flavoring substances 102, 103 is more than about 0.74 grams, there may be excess foaming. In some embodiments, the amount of salt in flavoring substances 102, 103 may be between about 0.55 grams and about 0.74 grams to yield desirable taste and foam levels. In some embodiments, the quantity of salt may be between about 0.5 grams and about 0.8 grams, and the quantity of dehydronated lime crystals may be between about 0.5 grams and about 0.7 grams.

For some beverages, such as beer, with which lime is used as a flavoring substance, the amount and type of lime flavoring included in flavoring substances 102, 103 may determine the overall lime taste and the balance of lime taste to the taste of the beverage and may affect the foaming amount and rate. Lime flavoring substances may include those noted above or any other suitable type of lime juice, lime crystals, or other lime flavoring. In some embodiments, flavoring substances 102, 103 may include less than about 0.6 grams of lime crystals to balance lime flavoring with the flavoring of the beverage. In some embodiments, including less than about 0.6 grams of lime crystals in the flavoring substances 102, 103 may also yield desirable taste and total foaming and/or foaming rate when flavoring substances 102, 103 are introduced into the beverage. In some embodiments, flavoring substances 102, 103 may include about ⅜ teaspoon lime juice, or other similar amount substantially equal to one-eighth (⅛) of a medium sized lime (e.g. a typical slice of lime), or lime crystals with sufficient water to produce about ⅜ teaspoon lime juice when mixed. In some embodiments, flavoring substances 102, 103 may include only lime juice, only lime crystals, lime crystals and lime juice, or lime crystals and water. In some embodiments, flavoring substances 102, 103 may include about 1 part salt/lime crystal mixture to about 13 parts water. In some embodiments, flavoring substances 102, 103 may include about 1 part salt to about 1.05 parts lime crystals.

In some embodiments, such as beer, for example, one or more anti-foaming agents may be included in flavoring substances 102, 103 to reduce the amount of foaming caused when flavoring substances 102, 103 are added to the beverage container. In some embodiments, Antifoam A Compound available from Dow Corning Corporation (Midland, Mich.) or CD-2020 powdered silicone antifoam available from New London Chemicals, Inc. (Lakeland, Fla.) may be used. Such anti-foaming agents, which may be liquid, solid, or a combination thereof, may be placed in either or both of cups 114, 115 with either liquid or dry flavoring substances 102, 103. For example, in some embodiments, about 0.03 grams of CD-2020 powdered silicone antifoam may be placed in cup 115 with about 0.55 grams of salt and about 0.58 grams of dehydronated lime crystals, and about 1 ml of water may be placed in cup 114. In some embodiments, the loading apparatus may be agitated during the process of loading anti-foaming agents into cups 114, 115 to enhance mixing and effectiveness of the anti-foaming agents with the flavoring substances 102, 103. In some embodiments, anti-foaming agents may not be incorporated in flavoring substances 102, 103 to preserve the natural flavoring of flavoring substances 102, 103. In some embodiments, other compounds with anti-foaming or foam-eliminating properties may be included in flavoring substances 102, 103.

By way of non-limiting example, cup 115 may contain approximately ¼ teaspoon of granulated salt disposed therein, and cup 114 may have approximately ¾ teaspoon of fresh lime juice disposed therein. In another example embodiment suitable for dressing Mexican beer, cup 115 may contain about 0.55 grams of salt and about 0.58 grams of dehydronated lime crystals, while cup 114 may contain about one-fourth of a teaspoon of water. Thus, the salt and lime crystals may remain intact in solid, dry form until mixed with the water when cup assembly 100 is pierced by spike 302 as plunger 300 is moved to the deployed position. The latter example yields a suitable taste and an acceptable amount of foam without the use of an anti-foaming agent. In the latter example, cup 114 may have an internal volume of about 0.23 in.$^3$ and cup 115 may have an internal volume of about 0.38 in.$^3$. Of course, any desired volume and sizing of cups 114, 115 may be used, depending on the particular application.

In some embodiments, cup assembly 100 may have more than two cups 114, 115 or chambers 111, 112. Cup assembly 100 may be adapted to accommodate any desired number of such cups or chambers containing any desired number of flavoring substances. Although cups 114, 115 illustrated in FIGS. 3, 6-10, 12, and 15 are shown in a nested arrangement such that chambers 111, 112 and flavoring substances 102, 103 are generally oriented one above the other, chambers 111, 112 may be arranged side by side or in any other desired arrangement. Additionally, plunger 300 may have one or more spikes 302 to penetrate one or more chambers, and any given spike 302 may be configured to penetrate only one chamber or multiple chambers. One or more spikes 302 may be integral to plunger 300 or may be separate components that are suitably attached to the body of plunger 300.

Figure 8:
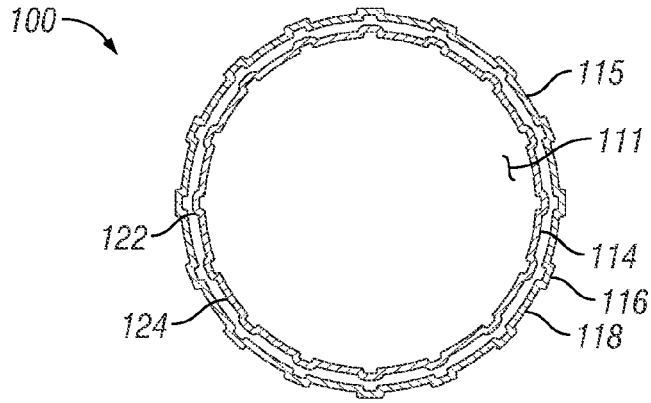
FIG. 8 is a cross-sectional view of the cup assembly of FIG. 7 taken in the direction of arrows 8-8 of FIG. 7.

As best shown in FIG. 8, cup 115 may contain ridges 116 on sidewalls 118, while cup 114 may contain ridges 122 on sidewalls 124. Such ridges 116, 122 may help provide sufficient stiffness for sidewalls 118, 124. While ridges 116, 122 are shown to be generally aligned with each other in FIG. 8, cups 114, 115 may be sized such that there is sufficient room between cups 114, 115 so that ridges 116, 122 need not align. In some embodiments, ridges 116, 122 may be nested one within the other.

Cups 114, 115 may be manufactured, loaded with flavoring substances 102, 103, and assembled in any suitable manner. In some embodiments, an MR-35™ rotary fill and seal machine available from ORICS Industries, Inc. (Farmingdale, N.Y.) may be configured to load cups 114, 115 with flavoring substances 102, 103, assemble cups 114, 115 in a nested arrangement, and apply a heat seal 120 to cups 114, 115 as shown in FIG. 9. The machine may have a round, rotary table mounted on an index drive, a motor, a gear reducer, and an adjustable speed controller. The machine may include a denester that may denest a cup 115 from a stack of cups 115 and place such cup 115 into a carrier disposed on the rotary table. The rotary table may index the cup 115 to the next station for loading with a first flavoring substance (such as salt, for example) via a first filler, such as a MICRO 14S™ servo-driven auger filler available from Per-Fil Industries (Riverside, N.J.). The rotary table may then index the cup 115 to the next station for loading with a second flavoring substance (such as lime crystals, for example) via a second filler, which may also be a MICRO 145™ filler or another suitable filler. The rotary table may then index cup 115 to the next station at which a cup 114 may be denested from a stack of cups 114 into cup 115, thus forming a cup assembly 100. The rotary table may then index the cup assembly 100 to the next station at which a liquid filler may load cup 114 with a liquid (such as water or lime juice, for example). The rotary table may then index cup assembly 100 to the next station at which a film seal 120 may be heat sealed to cups 114 and 115. The rotary table may then index cup assembly 100 to a discharge station and onto an outfeed conveyor. A printer may be provided with the outfeed conveyor to print a label on seal 120 and/or an outer surface of cup 115. The machine may include a rotary die cut film feed apparatus for cutting seal 120 from a sheet of film. The machine may include a programmable computer for controlling its operation. Of course, any other suitable manufacturing machines and processes may be employed, depending on the particular application.

Figure 13:
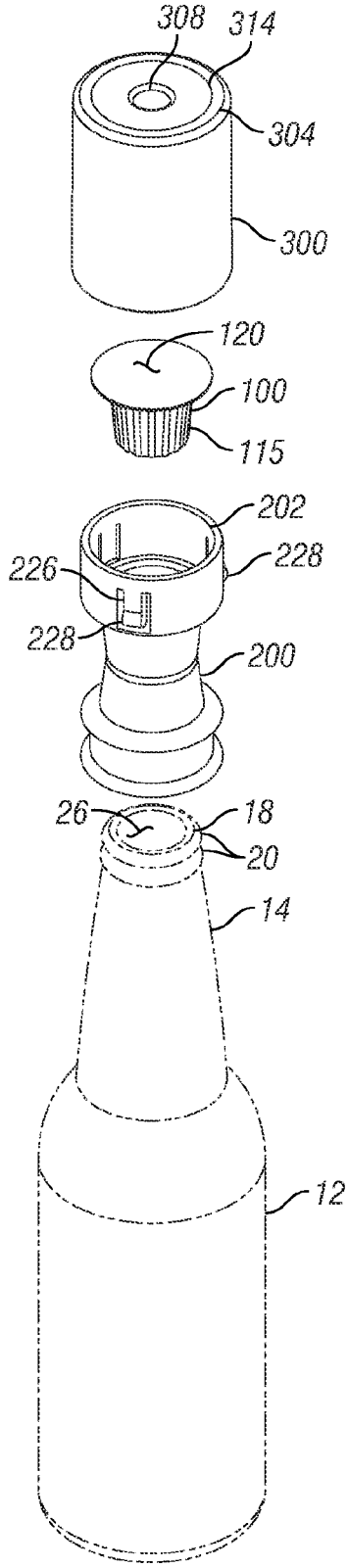
FIG. 13 is an exploded perspective view of the flavoring applicator and bottle of FIG. 11.

Flavoring applicator 10 may be used as follows: a user may place lower portion 208 of internal channel 206 over and onto mouth 26 of bottle 12 or other container and may place cup assembly 100 through crown 218 and into upper portion 212 of housing 200, as shown in FIGS. 12-13. The user may position plunger 300 onto housing 200 and apply downward pressure to plunger 300, thereby causing plunger 300 to telescope down over housing 200, which causes spike 302 disposed within plunger 300 to puncture seal(s) 120 and cups 114, 115 of cup assembly 100, as shown in FIG. 6, thereby releasing all or a portion of flavoring substances 102, 103 disposed within cup assembly 100 and allowing substances 102, 103 to be distributed into bottle 12 and/or onto rim 18 of bottle 12. In the case of a can 12*a*, flavoring substances 102, 103 may also be distributed onto a top surface 24 of can 12*a*. In some embodiments, the various components of flavoring applicator 10 may be sized, shaped, and made of suitable materials such that the application of downward pressure to plunger 300 involves manually and abruptly hitting a top portion of plunger 300 to yield desired dispensing characteristics.

In some embodiments, flavoring applicator 10 may be pre-assembled, such that cup assembly 100 is pre-loaded into housing 200 and plunger 300 is pre-installed onto housing 200 and ready for immediate use. In some embodiments, such as single-use embodiments, for example, a ridge and groove, tab and recess, or other type of detent structure may be respectively provided on housing 200 and plunger 300 such that when plunger 300 is fully deployed, it may not be retracted. In other embodiments, plunger 300 may be readily removed from housing 200 such that housing 200 may be loaded with another cup assembly 100 and used again.

Figure 25:
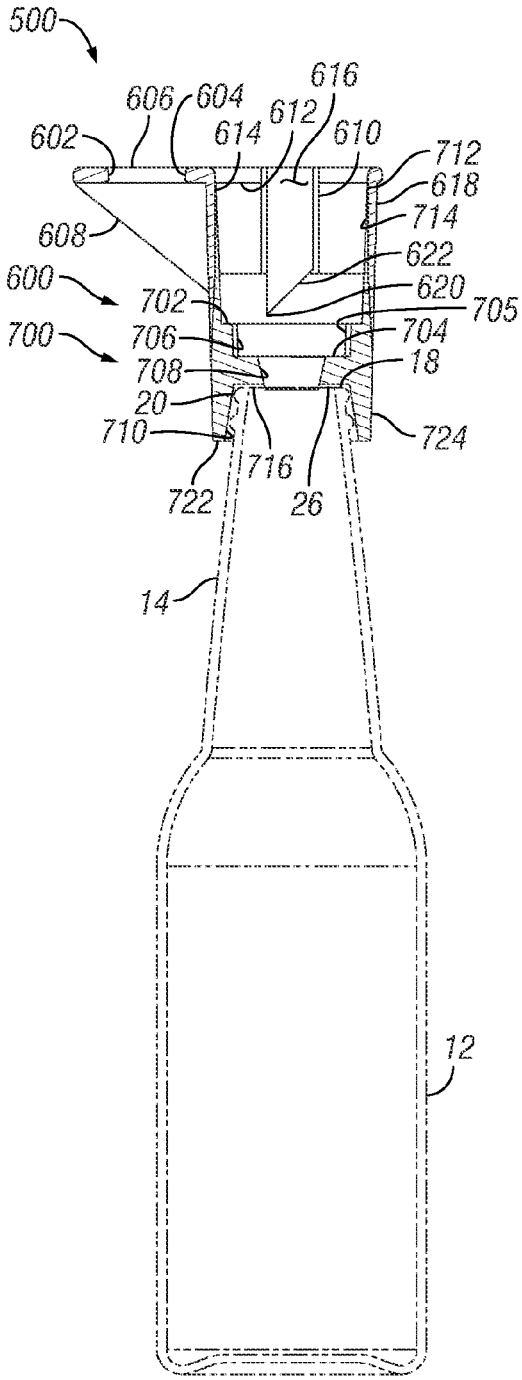
FIG. 25 is a cross-sectional view of the flavoring applicator of FIG. 20 shown in a retracted position applied to a beverage bottle.
Figure 26:
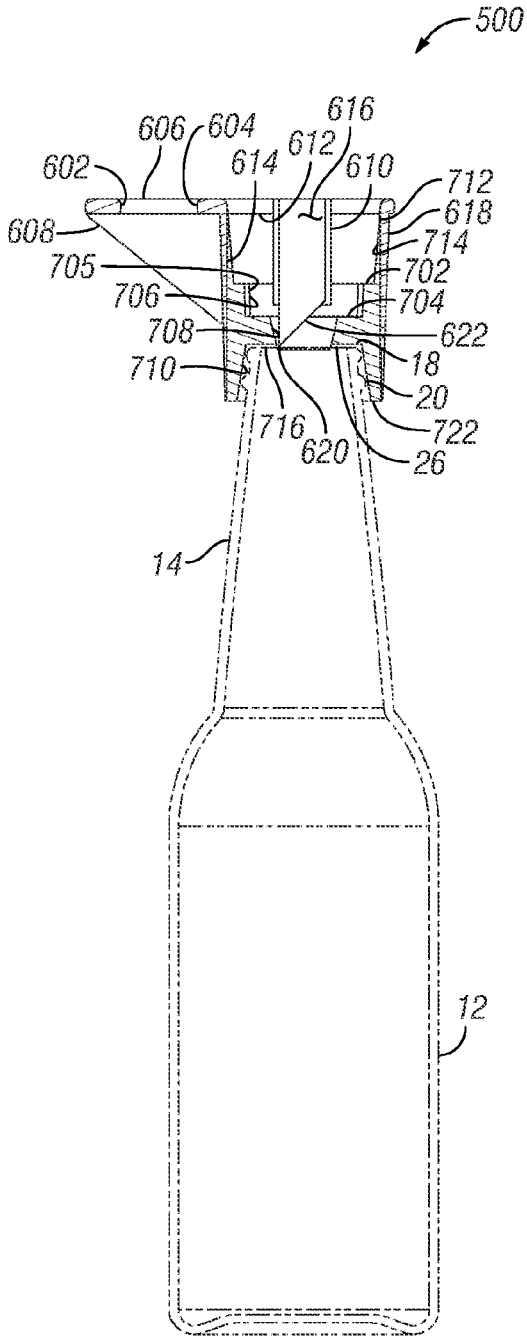
FIG. 26 is a cross-sectional view of the flavoring applicator of FIG. 20 shown in a deployed position applied to a beverage bottle.

In some embodiments, flavoring applicator 10 may be configured to operate with an open beverage container 12. In other embodiments, a flavoring applicator 500 may have a bottle opener, can opener, or other device to open a bottle 12, or other beverage container, as well as dispense flavoring substances onto or into such beverage containers. For example. FIGS. 20-26 illustrate an alternative embodiment of a flavoring applicator 500 having a bottle opener. In some embodiments, flavoring applicator 500 may include a housing 700 and a plunger 600. Housing 700 may include a channel 705 which extends from a top edge 712 of housing 700 to a base 722 of housing 700. Channel 705 may include an upper portion 706 configured to receive a cup assembly (not shown), a middle portion 708 attached to a lower end of upper portion 706 and configured to receive a lower end of the cup assembly (not shown), and a lower portion 710 attached to a lower end of middle portion 708 which is configured to receive mouth 26 and rim 18 of bottle 12. Housing 700 may also include a series of ledges 702, 704. Ledge 704 may be configured to hold the cup assembly (not shown) in a substantially stationary position while ledge 702 may be configured to direct the cup assembly into the correct position on ledge 704. A top portion 714 of housing 700 may be attached to an upper end of upper portion 706 of channel 705 and may be open at its top and at its junction with upper portion 706 of channel 705 such that the cup assembly may be loaded through upper portion 706. Housing 700 may also include a lower ledge 716 which may contact rim 18 of bottle 12 when housing 700 is installed on bottle 12, as shown in FIGS. 25 and 26.

Flavoring applicator 500 may also include plunger 600 which slidably engages housing 700, as shown in FIGS. 25 and 26. Plunger 600 may include a spike 610 which attaches to an interior ceiling 612 of plunger 600. Spike 610 may include a sharp edge 622 and a point 620 which are configured to puncture a seal and base of the cup assembly (not shown) and to allow the contents of the cup assembly to escape the cup assembly. Spike 610 may also have a central cavity 616 which extends from interior ceiling 612 of plunger 600 to point 620 of spike 610.

FIGS. 25 and 26 show flavoring applicator 500 in use. Housing 700 may be placed on mouth 26 and rim 18 of a bottle 12 such that rim 18 contacts a lower ledge 716 of housing 700 and ridges 20 of bottle 12 contact lower portion 710 of channel 705. A cup assembly (not shown) may be placed within housing 700 such that it rests within upper 706 and middle 708 portions of channel 705. Plunger 600 may be placed over housing 700 such that interior wall 614 of plunger 600 contacts exterior surface 724 of housing 700. By applying downward force to plunger 600, plunger 600 may be forced downward onto housing 700 and into the deployed position, as shown in FIG. 26. This allows spike 610 to puncture the cup assembly (not shown) and dispel the contents of the cup assembly into and onto bottle 12.

Figure 24:
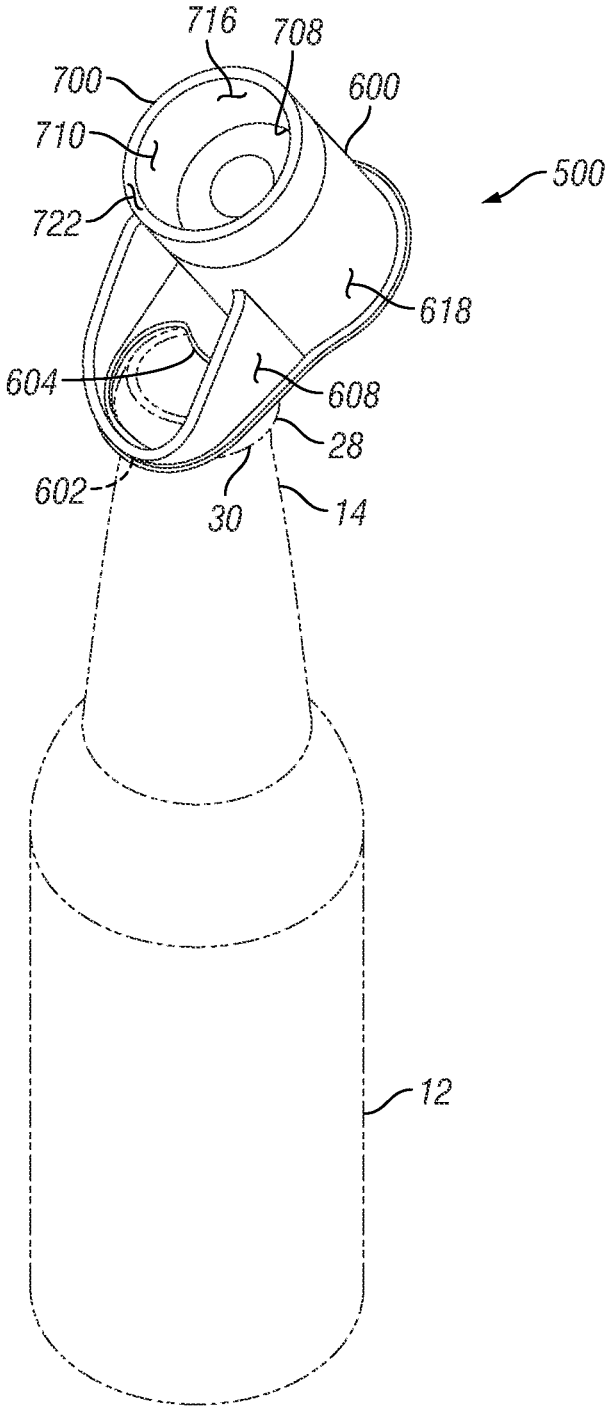
FIG. 24 is a perspective view of the flavoring applicator of FIG. 20 with its bottle opener applied to a beverage bottle.

Additionally, as shown in FIGS. 20-24, flavoring applicator 500 may act as a bottle opener. Plunger 600 may include a wall 608 which extends from the plunger's cylindrical body 618 to create a cavity 606. Cavity 606 may include a nub 602 and a nub 604, which act as force transferring elements to remove a bottle cap 28 from bottle 12. Nub 602 may extend partway into cavity 606 and nub 604 may extend partway into cavity 606. Each of nubs 602 and 604 may be configured to apply pressure to bottle cap 28. As shown in FIG. 24, flavoring applicator 500 may be placed such that bottle cap 28 extends partway through cavity 606. Nub 602 may contact a lower edge 30 of bottle cap 28 while nub 604 applies pressure to the top of bottle cap 28. By applying pressure to flavoring applicator 500 while it is held in this position, bottle cap 28 can be forced off of bottle 12.

Although the foregoing specific details describe certain embodiments of this invention, persons reasonably skilled in the art will recognize that various changes may be made in the details of this invention without departing from the spirit and scope of the invention in view of the claims that may be drawn hereto and considering the doctrine of equivalents. Wording such as upper, lower, top, bottom, first, second, and the like are used only in a distinguishing sense and are not intended to imply a certain order, orientation, or other limitation of the apparatus or its elements, unless the context specifically so requires. Therefore, it should be understood that this invention is not to be limited to the specific details shown and described herein.

What is claimed is:

1. A beverage flavoring applicator, comprising:

a housing having an internal channel;

a cup assembly disposed in said internal channel, said cup assembly comprising:

a first cup having a first chamber with a first flavoring substance disposed in said first chamber;

a second cup having a second chamber with a second flavoring substance disposed in said second chamber;

said first and second cups being nested one within the other; and a plunger slidably engaged with said housing, said plunger having a spike configured to rupture said first and second cups upon movement of said plunger from a first position to a second position with respect to said housing, thereby dispensing said first and second flavoring substances from said applicator.

2. The beverage flavoring applicator of claim 1, wherein said first cup further comprises a first flange disposed on an upper end of said first cup, wherein said second cup further comprises a recess and a second flange disposed on an upper end of said second cup, wherein said first flange is disposed in said recess.

3. The beverage flavoring applicator of claim 2, wherein said first flange further comprises a first upper surface and said second flange further comprises a second upper surface, wherein said first and second upper surfaces are substantially flush with each other.

4. The beverage flavoring applicator of claim 3, further comprising a seal attached to said first and second upper surfaces.

5. The beverage flavoring applicator of claim 1, wherein said first flavoring substance comprises a liquid and said second flavoring substance comprises a granular solid.

6. The beverage flavoring applicator of claim 5, wherein said liquid comprises water and said granular solid comprises salt and dehydronated lime crystals.

7. The beverage flavoring applicator of claim 5, wherein said liquid comprises about one-fourth of a teaspoon of water and said granular solid comprises about 0.55 grams of salt and about 0.58 grams of dehydronated lime crystals.

8. The beverage flavoring applicator of claim 1, wherein said plunger further comprises an internal thread and wherein said housing further comprises a protrusion disposed on a flexible tab of said housing, wherein said protrusion is configured to releasably and threadably engage said internal thread.

9. The beverage flavoring applicator of claim 1, wherein said spike comprises a cylindrical body, four blades in a cruciform orientation, and an upper wall, wherein said cylindrical body, said four blades, and said wall form four compression chambers, wherein said compression chambers house pressurized air during at least a portion of said movement.

10. The beverage flavoring applicator of claim 1, wherein said first flavoring substance is positioned above said second flavoring substance.

11. A beverage flavoring applicator, comprising:

a housing, wherein said housing comprises an internal channel extending from a top edge of said housing to a base of said housing, wherein said internal channel is open at said top edge and at said base, wherein said internal channel comprises an upper portion having a frustoconical shape, wherein said internal channel further comprises first, second and third annular ledges on an upper portion of said frustoconical shape and internal protrusions on a lower portion of said frustoconical shape;

a cup assembly disposed within said upper portion of said internal channel, wherein said cup assembly comprises:

a first cup comprising a first annular flange and a first chamber, wherein said first flange extends from an upper edge of said first cup and wherein said first chamber comprises a first flavoring substance;

a second cup comprising a second annular flange, a recess, and a second chamber, wherein said second flange extends from an upper edge of said second cup and wherein said second chamber comprises a second flavoring substance;

said first cup being nested within said second cup such that said first flange of said first cup is disposed within said recess of said second cup, wherein a first upper surface of said first flange is substantially coplanar with a second upper surface of said second flange;

a seal disposed on said first upper surface and said second upper surface, whereby said first flavoring substance is sealed within said first chamber and said second flavoring substance is sealed within said second chamber;

a first shoulder and a second shoulder, wherein said first shoulder is disposed in said first annular ledge, said second shoulder is disposed in said second annular ledge, and said second flange is disposed in said third annular ledge;

a base configured to rest on said internal protrusions; and a plunger configured to fit over and slidably engage said housing, said plunger comprising a spike configured to puncture said first and second cups upon movement of said plunger from a first position to a second position with respect to said housing, said plunger further comprising internal threads which mate with protrusions disposed on flexible tabs of said housing, wherein said protrusions and said internal threads are configured for twisting initial engagement of said plunger with said housing.

12. The beverage flavoring applicator of claim 11 wherein:

said first flavoring substance comprises a quantity of water; and said second flavoring substance comprises a quantity of salt and a quantity of dehydronated lime crystals.

13. The beverage flavoring applicator of claim 12 wherein:

said first flavoring substance comprises about ¼ teaspoon of water; and said second flavoring substance comprises about 0.55 grams of salt and about 0.58 grams of dehydronated lime crystals.

14. The beverage flavoring applicator of claim 13 comprising no anti-foaming agent.

15. The beverage flavoring applicator of claim 12 wherein:

said quantity of salt is between about 0.5 grams and about 0.8 grams; and said quantity of dehydronated lime crystals is between about 0.5 grams and about 0.7 grams.

16. The beverage flavoring applicator of claim 12 wherein:

a ratio of said quantity of salt to said quantity of dehydronated lime crystals is about 1 part salt to about 1.05 parts dehydronated lime crystals.

17. The beverage flavoring applicator of claim 12 wherein:

a ratio of said first flavoring substance to said second flavoring substance is about 13 to 1.

18. A beverage flavoring applicator and adapter, comprising:

a housing having an internal channel;

a cup assembly disposed in said internal channel, said cup assembly comprising a first chamber having a first flavoring substance and a second chamber having a second flavoring substance, wherein said first flavoring substance is positioned above said second flavoring substance;

a plunger slidably engaged with said housing, said plunger having a spike configured to rupture said first and second chambers upon movement of said plunger from a retracted position to a deployed position with respect to said housing; and an adapter comprising a top surface with an aperture therethrough, an open boss extending upwardly from said top surface about said aperture, and an open skirt extending downwardly from said top surface, said skirt being configured to mate with a top portion of a beverage can;

wherein said boss is configured to accept said first and second flavoring substances from said internal channel and direct said first and second flavoring substances onto the beverage can.

* * * * *

UNITED STATES PATENT AND TRADEMARK OFFICE

CERTIFICATE OF CORRECTION

PATENT NO. : 8,522,968 B2
APPLICATION NO. : 13/106749
DATED : September 3, 2013
INVENTOR(S) : Mark L. Middleman et al.

It is certified that error appears in the above-identified patent and that said Letters Patent is hereby corrected as shown below:

In the Specification

In column 9, line 3, change “lour” to --four--;

In column 9, line 21, change “scaling” to --sealing--.

Signed and Sealed this
Twenty-second Day of October, 2013

Teresa Stanek Rea
*Deputy Director of the United States Patent and Trademark Office*